US011414807B2

(12) United States Patent
Huang et al.

(10) Patent No.: US 11,414,807 B2
(45) Date of Patent: Aug. 16, 2022

(54) DETERGENT DISPENSING DEVICE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Yuliang Jiang, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/058,195

(22) PCT Filed: Dec. 25, 2019

(86) PCT No.: PCT/CN2019/128214
§ 371 (c)(1),
(2) Date: Nov. 24, 2020

(87) PCT Pub. No.: WO2020/147531
PCT Pub. Date: Jul. 23, 2020

(65) Prior Publication Data

US 2021/0372026 A1 Dec. 2, 2021

(30) Foreign Application Priority Data

Jan. 18, 2019 (CN) ..... 201910048381.3

(51) Int. Cl.
*D06F 39/02* (2006.01)

(52) U.S. Cl.
CPC ..... *D06F 39/028* (2013.01); *D06F 39/022* (2013.01)

(58) Field of Classification Search
None
See application file for complete search history.

(56) References Cited

U.S. PATENT DOCUMENTS

2011/0277515 A1* 11/2011 Doh ..... D06F 39/022 68/17 R

FOREIGN PATENT DOCUMENTS

CN 201087291 Y 7/2008
CN 201915260 U 8/2011
(Continued)

OTHER PUBLICATIONS

Espacenet translation CN109183360A Detergent box and washing machine with same, Jiang (Year: 2019).*
(Continued)

*Primary Examiner* — Cristi J Tate-Sims
(74) *Attorney, Agent, or Firm* — Buchanan Ingersoll & Rooney PC

(57) ABSTRACT

A detergent dispensing device comprises a water box and a feeding box. A feeding chamber is in the feeding box, and has a stop plate for preventing water from flowing toward a water outlet. A siphon on the stop plate communicates one side with the other side, so that at an upstream side of the stop plate, a detergent and water flow fed to the water box from the feeding box is blocked by the stop plate and accumulated up to a water level for triggering a siphonic effect, and then flows to a downstream side along the siphon, and flows out from the water box via the water outlet. By the above arrangement, the detergent fed in the feeding chamber by a user is blocked by the stop plate, diluted by water, and then flows to the downstream side of the stop plate along the siphon.

10 Claims, 9 Drawing Sheets

(56) References Cited

FOREIGN PATENT DOCUMENTS

| | | | | | |
|---|---|---|---|---|---|
| CN | 102686791 | A | | 9/2012 | |
| CN | 104711821 | A | | 6/2015 | |
| CN | 107287837 | A | | 10/2017 | |
| CN | 208266482 | U | | 12/2018 | |
| CN | 109183360 | A | | 1/2019 | |
| DE | 8215268 | U1 | | 10/1982 | |
| EP | 0247686 | A2 | | 12/1987 | |
| GB | 2187764 | A | * | 9/1987 | ..... D06F 39/02 |
| GB | 2187764 | A | | 9/1987 | |
| KR | 20120073577 | A | | 7/2012 | |

OTHER PUBLICATIONS

International Search Report (with English Translation) and Written Opinion issued in corresponding International Patent Application No. PCT/CN2019/128214, 10 pages (dated Mar. 27, 2020).
Search report issued in corresponding EP Application No. 19877530A; dated Feb. 25, 2021. 1 Page.
Office Action issued in corresponding CN Application No. 20910048381; dated Oct. 26, 2021. 12 pages including English Abstract.

* cited by examiner

DETERGENT DISPENSING DEVICE

TECHNICAL FIELD

The present invention belongs to the field of washing devices and particularly relates to a washing feeding device applied to a washing machine.

BACKGROUND

A washing feeding device of a washing machine is installed on a machine body. A feeding chamber or a liquid storage chamber is arranged on the washing feeding device to make a user add a washing additive to the feeding chamber or the liquid storage chamber manually, and then introduced water of the washing machine is used to flush the added washing additive to a water holding container of the washing machine. The current washing additive generally has two forms: one is washing powder in a solid shape and the other is a liquid detergent, a disinfectant, a softener and the like.

Washing powder in a powder shape is generally placed into a chamber directly. After washing is started, the introduced water can be used to directly flush the washing powder away. However, only when a liquid washing additive is fed in a closed space, can it ensure that the additive is firstly diluted by flowing water in a washing process and then the diluted additive is washed away.

At present, the washing feeding device, in order to respectively feed different forms of washing additives, generally adopts the following manner: the washing powder in a powder shape and the liquid washing additives are respectively fed by different feeding chambers, requiring that corresponding structures are installed accordingly in the corresponding feeding chambers.

Therefore, how to set an adjusting structure in the same feeding chamber to make the feeding chamber simultaneously feed the solid and liquid washing additives has become a hot research and development issue.

Accordingly, the present disclosure is proposed herein.

SUMMARY

The technical problem to be solved in the present disclosure is to overcome defects of the prior art and a washing feeding device is provided for realizing a purpose of adaptively feeding different forms of washing additives, such as liquid washing additives and solid washing additives, respectively. Another objective of the present disclosure is to provide a washing feeding device to realize a purpose of reducing residue of the washing additives in chambers.

In order to solve the above technical problem, the basic concept of the technical solution disclosed in the present disclosure is as follows.

A washing feeding device comprises a water box, a feeding box installed in the water box, and at least one feeding chamber arranged in the feeding box. A stop plate, for preventing water from flowing toward a water outlet, is installed in the feeding chamber. A siphon is arranged on the stop plate for communicating one side with the other side, so that at an upstream side of the stop plate, a detergent and water flow fed to the water box from the feeding box flows to a downstream side of the stop plate along the siphon, and flows out from the water box via the water outlet after being blocked by the stop plate and accumulated up to a water level for triggering a siphonic effect.

Further, the siphon is an inverted U-shaped flow channel. Two ends of the flow channel are respectively located at two sides of the stop plate. A height of the flow channel at a corner is not smaller than a height of a top end of the stop plate.

Further, one end of the inverted U-shaped flow channel at the upstream side of the stop plate is a water inlet end, and another end of the inverted U-shaped flow channel at the downstream side of the stop plate is a water outlet end. The water inlet end and the water outlet end are apart from a bottom wall of the feeding chamber by an interval for allowing the detergent and the water flow to flow into or out of the flow channel.

Further, the water inlet end of the inverted U-shaped flow channel is higher than the water outlet end of the inverted U-shaped flow channel. Preferably, the bottom wall of the feeding chamber is arranged obliquely downward toward the water outlet in a direction vertical to the stop plate.

Further, the siphon comprises a main body which is fixedly installed or integrated onto the stop plate and is a tubular shape extending vertically and being hollow inside. A hollow portion of the main body with tubular shape is separated by the stop plate into two independent portions: a water inlet flow channel and a water outlet flow channel. A top of the main body with tubular shape is buckled with an upper cover in a sealing manner. A lower side of the upper cover is provided with a groove sinking inward. The groove is used for communicating tops of the water inlet flow channel and the water outlet flow channel.

Further, the top of the main body with tubular shape is provided with a circle of sealing rib protruding upward. Two circles of coordinating ribs protruding downward are arranged in the periphery of the upper cover. A groove is formed in middle of the coordinating rib at an inner circle. The two circles of coordinating ribs are separated by an interval to form an insertion slot. The sealing rib is inserted into the insertion slot to form sealed insertion between the upper cover and the tubular main body.

Further, the main body with tubular shape and the stop plate are integrally formed. The upper cover is buckled to and fixedly connected to the top of the main body with tubular shape.

Further, two sides, perpendicular to the stop plate, of the main body with tubular shape are planes. Two sides, parallel with the stop plate, of the main body with tubular shape are arc faces protruding toward an outer side of the main body.

Further, the stop plate is installed in the feeding chamber in an overturning manner. The stop plate is in vertical position while the detergent is fed into the water box from the feeding chamber, and the stop plate is in horizontal or oblique position while washing powder is fed into the water box by the feeding chamber, so as to flush the washing powder to the water outlet. Preferably, two ends of the top of the stop plate are respectively provided with rotary shafts protruding outward. The two rotary shafts are arranged coaxially and penetrate respectively into side walls of the feeding chamber, such that the stop plate is installed onto the feeding box in an axial rotation manner.

Further, when the stop plate is at the vertical position, two sides of the stop plate are correspondingly are contact with inner walls of the feeding chamber, a lower side of the stop plate is correspondingly contact with the bottom wall of the feeding chamber. Preferably, at least one limit portion protruding to the inside of the feeding chamber is arranged on the inner walls of the feeding chamber for making the limit portion abut against the stop plate to limit when the stop plate is in the vertical position.

By the above technical solution, the present disclosure has the following advantageous effects compared with the prior art.

1. Through the above arrangement, the detergent added by the user into the feeding chamber can be blocked by the stop plate, and the detergent diluted flows to the downstream side of the stop plate via siphon. Thereby it is avoided that the detergent flows into the water box directly in case of not being diluted by water, and a purpose of improving the efficiency of diluting the detergent and enlarging the distribution area of the detergent is achieved.

2. Through the above arrangement, the inlet water of the water box flows through the gap portion of the baffle board to wash the bottom wall of the feeding chamber blocked below the baffle board, thereby avoiding residue of the washing powder at the water outlet of the feeding chamber and realizing a purpose of preventing residue of the washing powder at the water outlet of the feeding chamber shielded by the baffle board.

3. Through the arrangement of the baffle board capable of overturning, a corresponding using state is adjusted when the feeding device respectively feeds the liquid and solid washing additives, thereby ensuring smooth feeding of the additives.

4. Via a downpipe arranged vertically on the feeding box of the feeding device in a penetrating manner, residual water on a top surface of the feeding box flows to the bottom of the water box below the feeding box through the downpipe, thereby avoiding residue of water on the top surface of the feeding box, and further preventing the residual water from leaking to the outside of the washing machine when the user pulls the feeding box out.

5. By arranging the blocking rib at the periphery of the siphon, the siphon and the feeding chamber are separated, to prevent the siphon from triggering siphoning by mistake due to increase of the liquid level at the siphon caused by surging liquid in the feeding chamber in a process of pulling the feeding box, thereby realizing a purpose of preventing "surging" of the siphon to avoid triggering siphoning by mistake.

6. By arranging a hollow portion located at the periphery of the siphon on the cover plate of the feeding chamber, the inlet water for washing on the top surface of the feeding box flows into the feeding chamber along the hollow portion, thereby avoiding residue of the inlet water on the top surface of the feeding box. Meanwhile, water on the top surface of the feeding box flows into the feeding chamber along the hollow portion close to the siphon, water flows downward along an outer wall of the siphon to wash an outer wall surface of the siphon, thereby avoiding residue of the detergent on the outer wall of the siphon and generation of water stain.

Meanwhile, the structure of the disclosure is simple, remarkable effects and is widely applied.

Accompanying drawings will be incorporated below to further describe specific embodiments of the present disclosure in details.

BRIEF DESCRIPTION OF THE DRAWINGS

The accompanying drawings, as a part of the present disclosure, are used for further understanding of the present disclosure. Illustrative embodiments of the present disclosure and description thereof are used for interpreting the present disclosure, but do not constitute undue limitation to the present disclosure. Obviously, the accompanying drawings described below are merely some embodiments. Under the precondition of not paying any creative labor, those skilled in the art can further obtain other accompanying drawings according to these accompanying drawings. In the accompanying drawings.

DESCRIPTION OF MAIN COMPONENTS IN THE DRAWINGS

100—feeding box, 200—water box, 1—feeding chamber; 2—liquid storage chamber; 3—locking rod; 4—stop plate; 5—siphon; 6—cover plate; 7—hollow portion; 8—groove; 9—auxiliary stop plate; 10—gap portion; 11—water outlet; 12—blocking rib; 13—downpipe; 14—drain gully; 15—groove; 16—locking portion; 17—upper cover; 18—shielding rib.

It should be noted that these accompanying drawings and written description are not aim to restrict scope of the conception of the present disclosure in any manner, but to describe the concept of the present disclosure for those skilled in the art with reference to specific embodiments.

DETAILED DESCRIPTION

In order to make the objective, the technical solution and advantages of the embodiments of the present disclosure clearer, the accompanying drawings in embodiments of the present disclosure will be incorporated below to describe the technical solutions in the embodiments of the present disclosure completely and clearly. The following embodiments are used for description of the present disclosure, yet without restricting the scope of the present disclosure.

In the description of the present disclosure, it should be noted that the orientation or position relationship indicated by terms such as "upper", "lower", "front", "rear", "left", "right", "vertical", "inner" and "outer" are orientation or position relationship indicated based on the accompanying drawings, the terms aim to facilitate description of the present disclosure and simplify the description, rather than to indicate or hint that the device or component indicated has a specific orientation, or is configured and operated at a specific orientation, and thus cannot be construed as restriction on the present disclosure.

In the description of the present disclosure, it should be noted that unless otherwise prescribed and defined clearly, terms such as "install", "communicate" and "connection" should be understood in a broad sense, for example, the connection may be a fixed connection and can also be a detachable connection or an integral connection, may be a mechanic connection and may also be an electrical connection, may be a direct connection and may also be an indirect connection through an intermediary. Those skilled in the art can understand the specific meanings of the above terms in the present disclosure depending on specific situations.

Embodiment I

Figure 1:
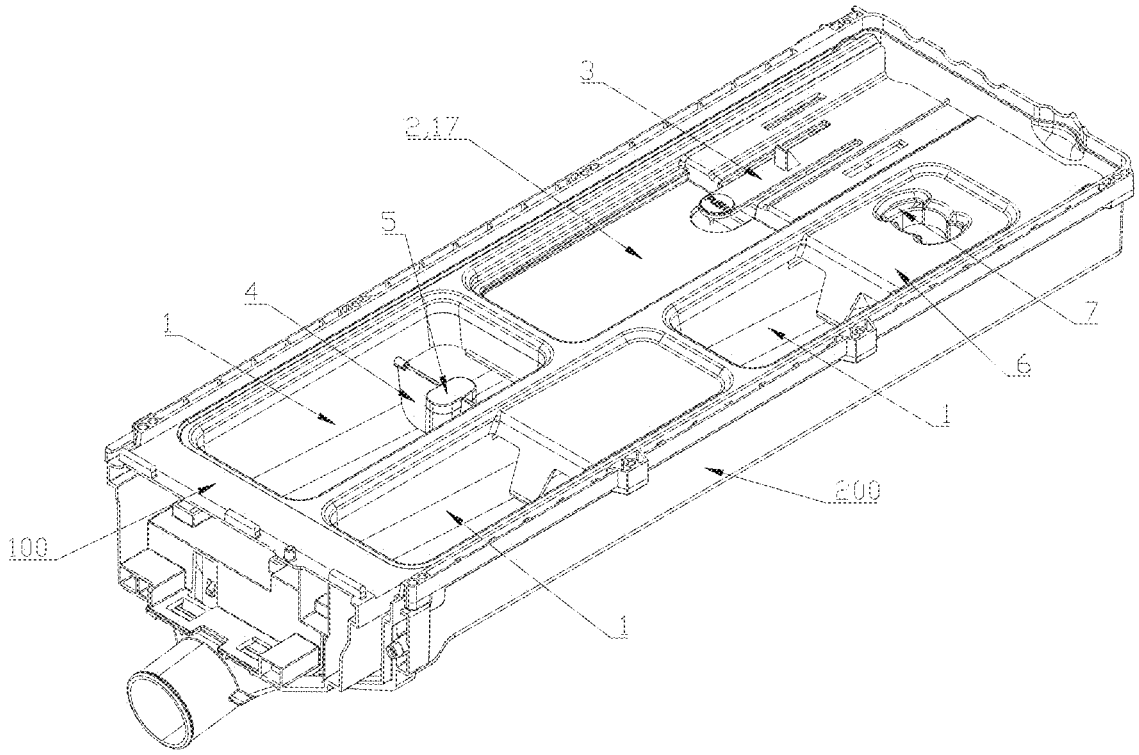
FIG. 1 is a structural schematic diagram of a washing feeding device in an embodiment of the present disclosure.
Figure 2:
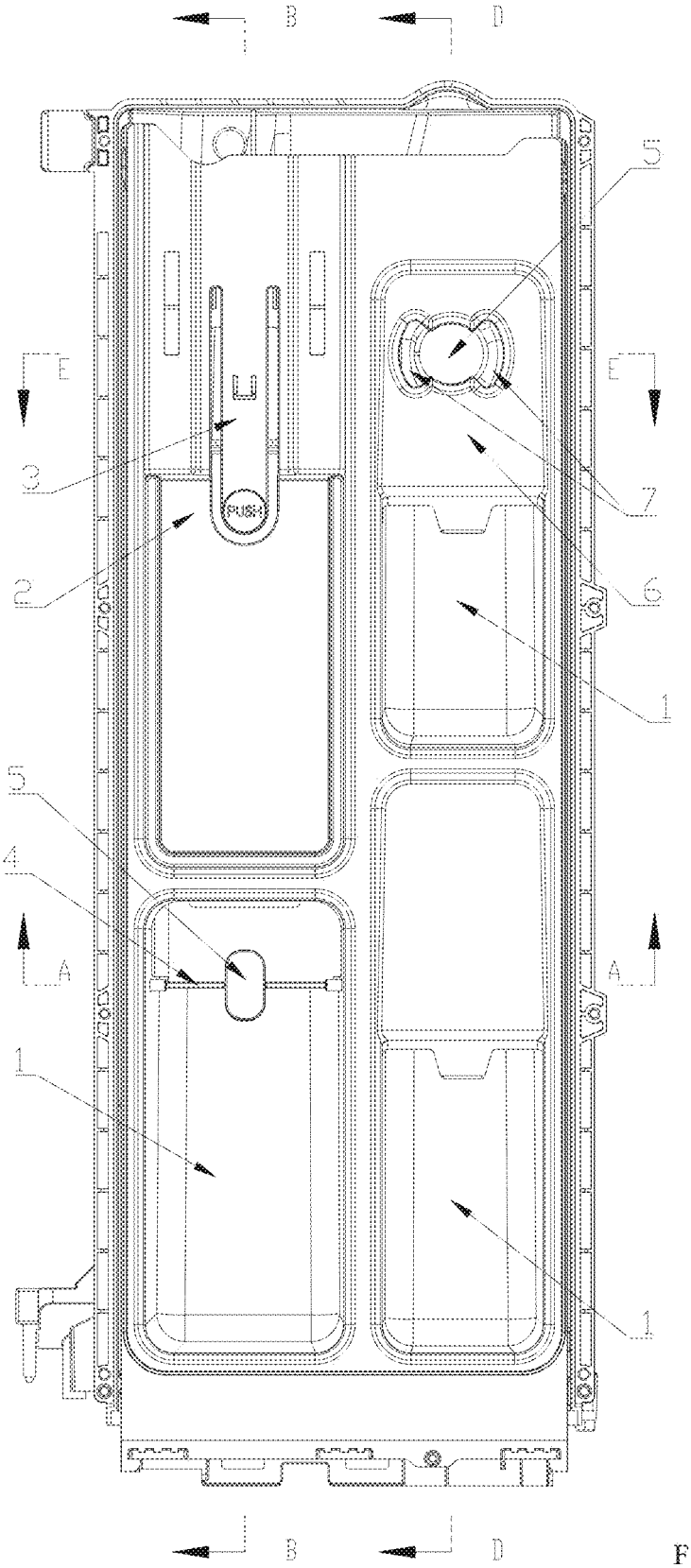
FIG. 2 is a top-view structural schematic diagram of a structure of a washing feeding device in an embodiment of the present disclosure.
Figure 3:
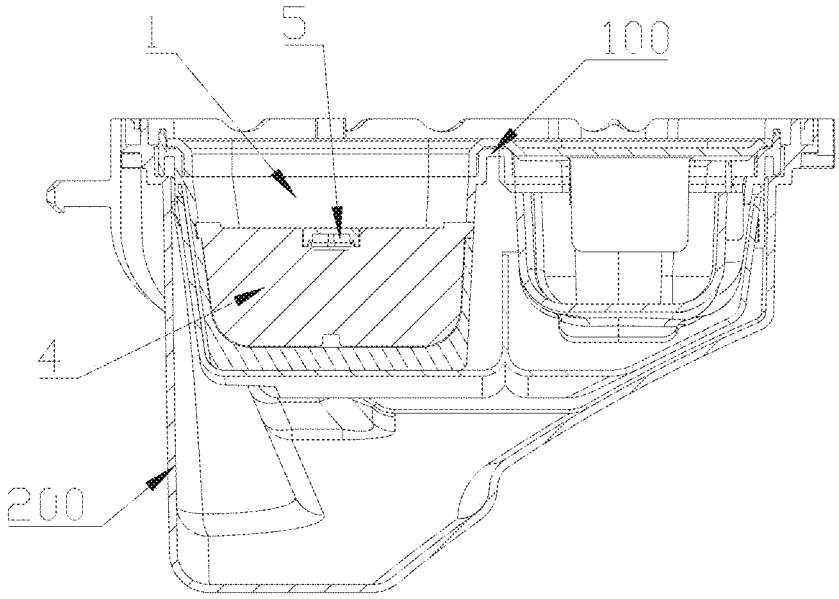
FIG. 3 is an A-A sectional view of FIG. 2 when a stop plate is at a vertically closing position in an embodiment of the present disclosure.
Figure 4:
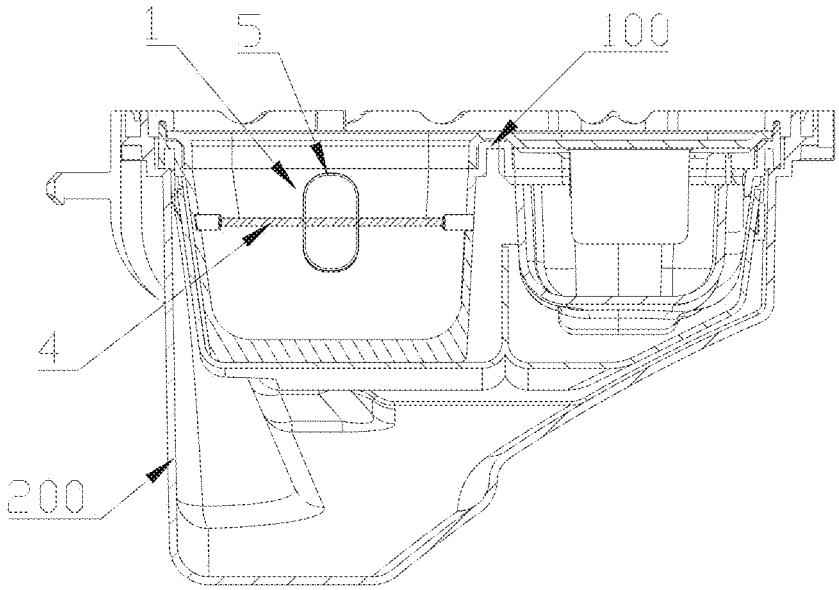
FIG. 4 is an A-A sectional view of FIG. 2 when a stop plate is at a horizontally opening position in an embodiment of the present disclosure.
Figure 5:
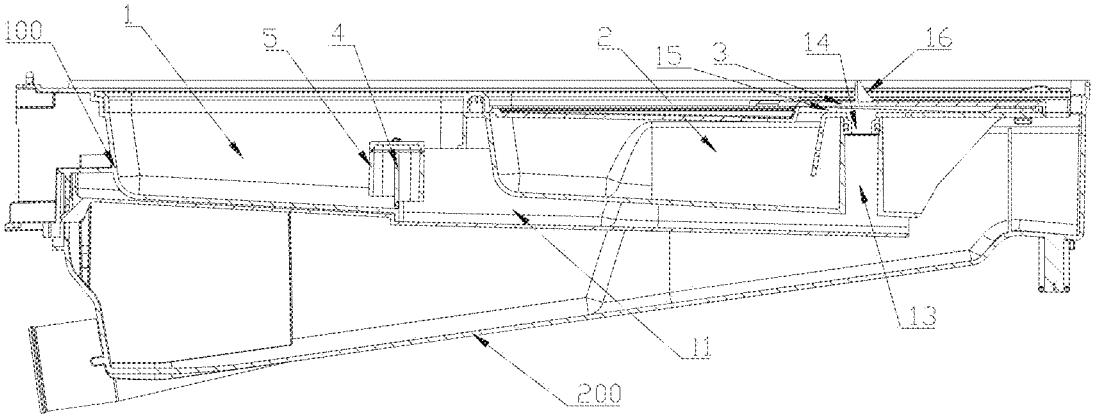
FIG. 5 is a B-B sectional view of FIG. 2 in an embodiment of the present disclosure.
Figure 6:
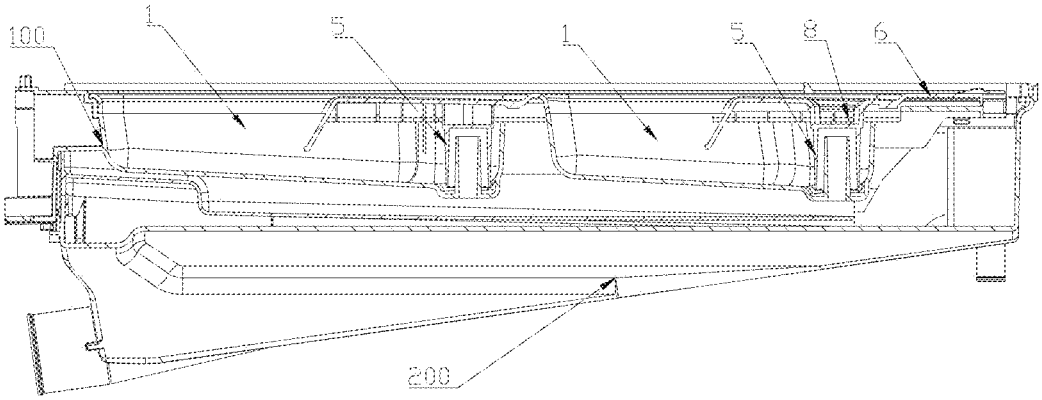
FIG. 6 is a D-D sectional view of FIG. 2 in an embodiment of the present disclosure.
Figure 7:
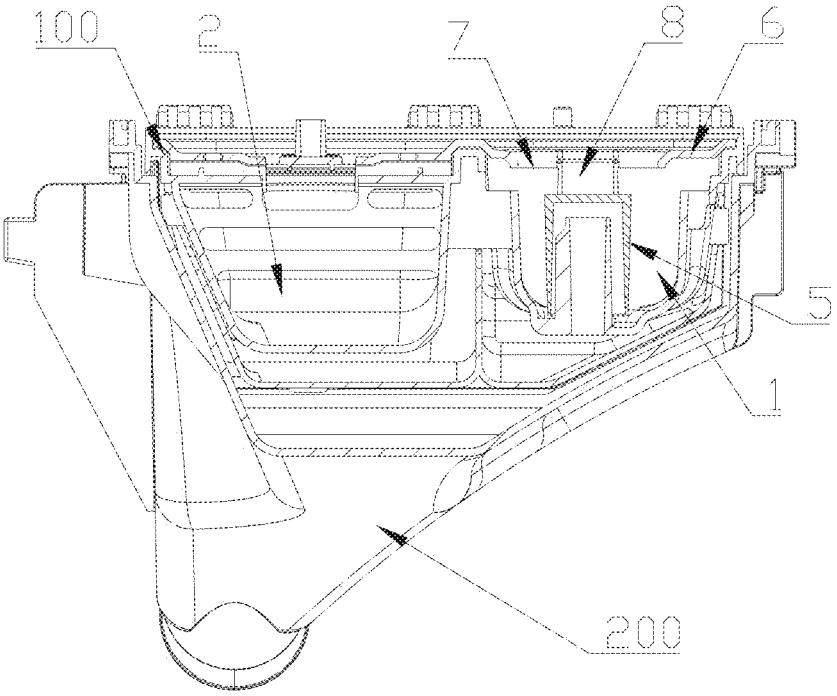
FIG. 7 is an E-E sectional view of FIG. 2 in an embodiment of the present disclosure.
Figure 8:
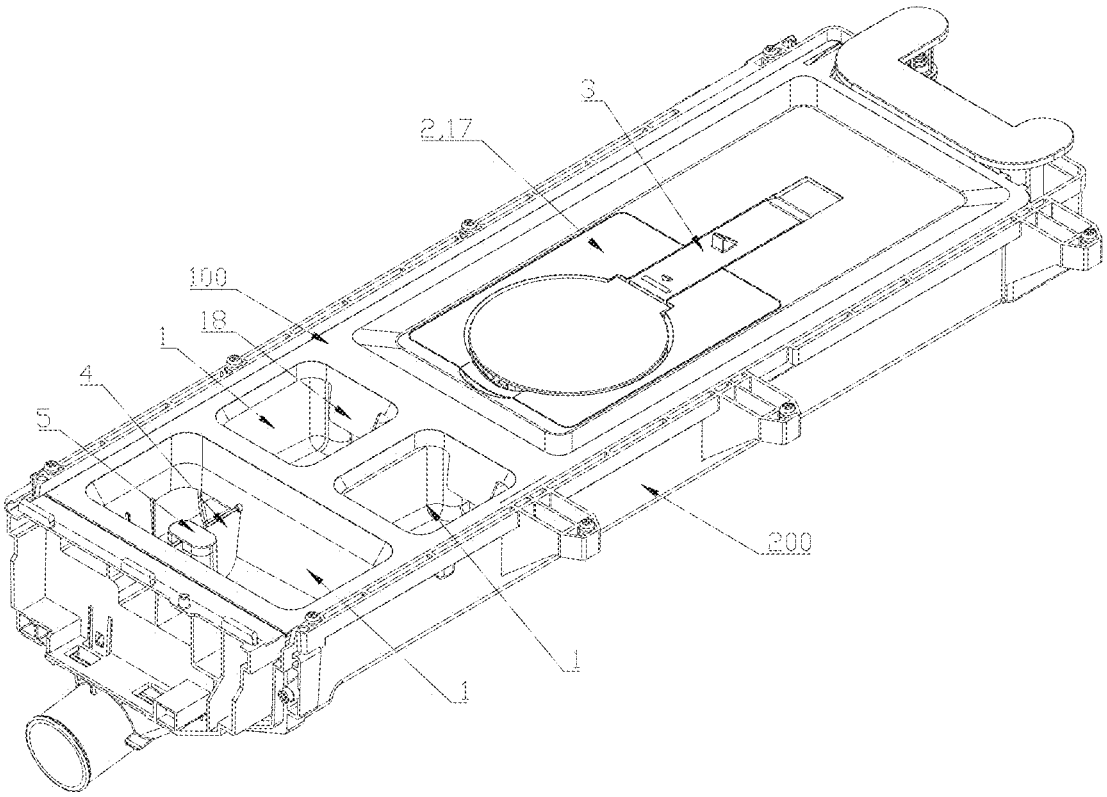
FIG. 8 is a structural schematic diagram of a washing feeding device in another embodiment of the present disclosure.
Figure 9:
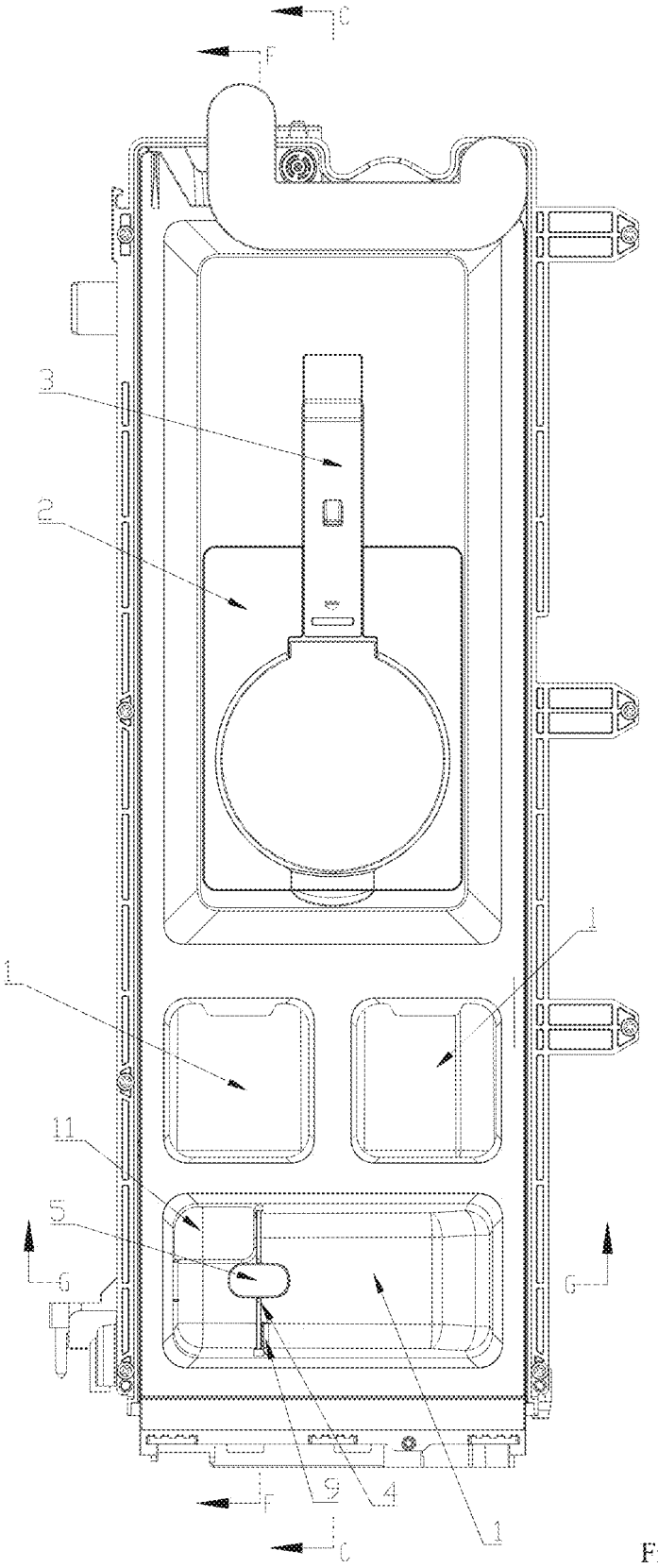
FIG. 9 is a top view of a washing feeding device when a stop plate is at a vertically closing position in another embodiment of the present disclosure.
Figure 10:
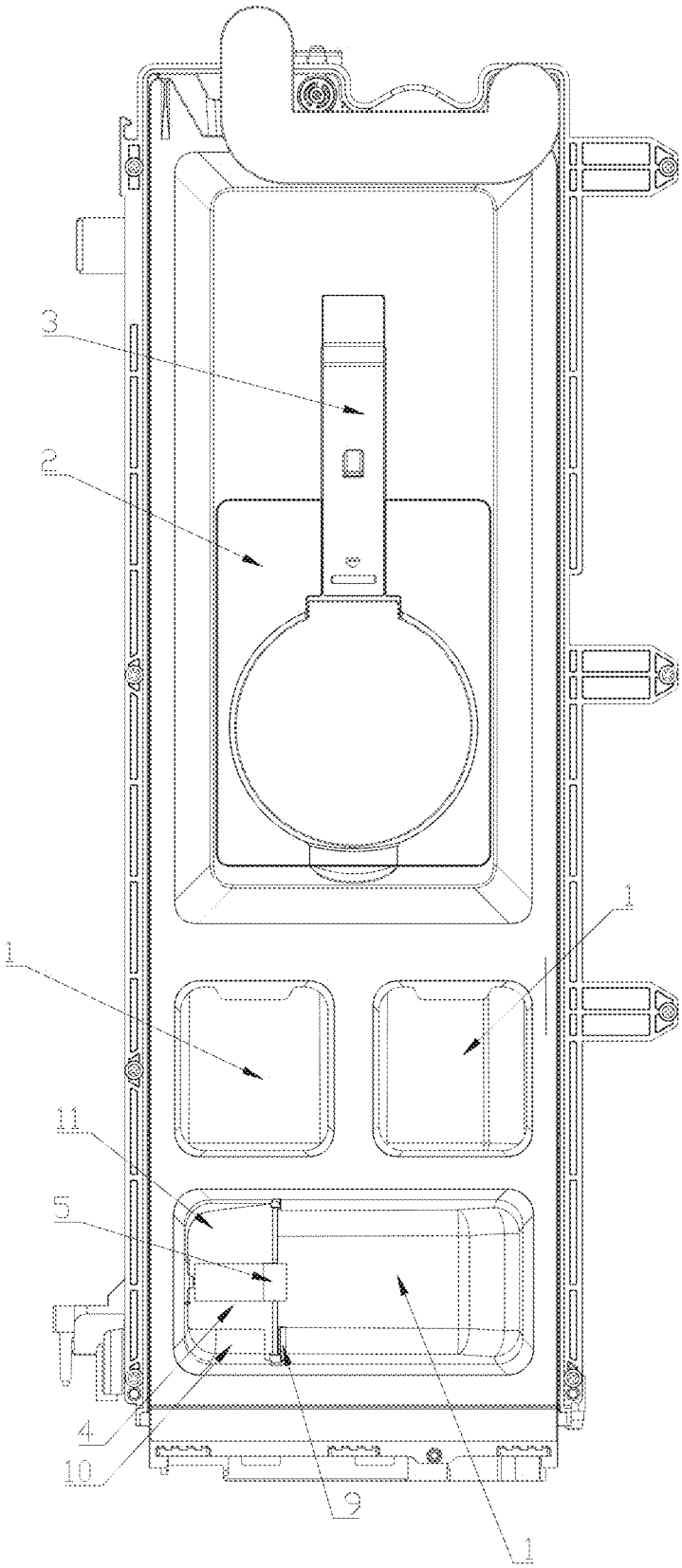
FIG. 10 is a top view of a washing feeding device when a stop plate is at a horizontally opening position in another embodiment of the present disclosure.
Figure 11:
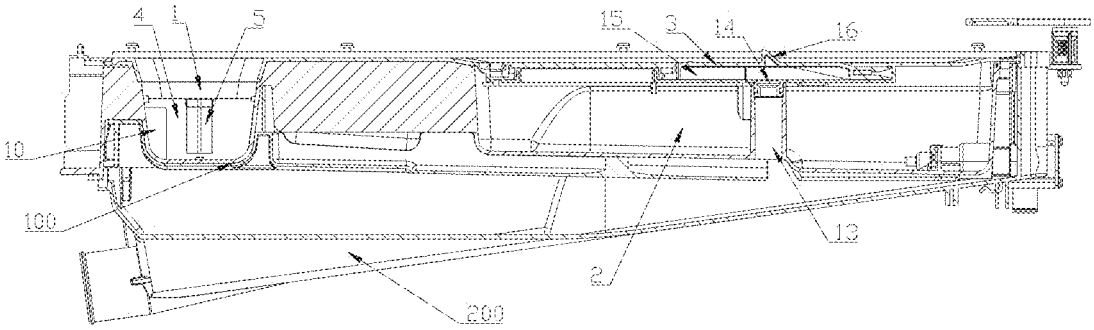
FIG. 11 is a C-C sectional view of FIG. 9 in an embodiment of the present disclosure.
Figure 12:
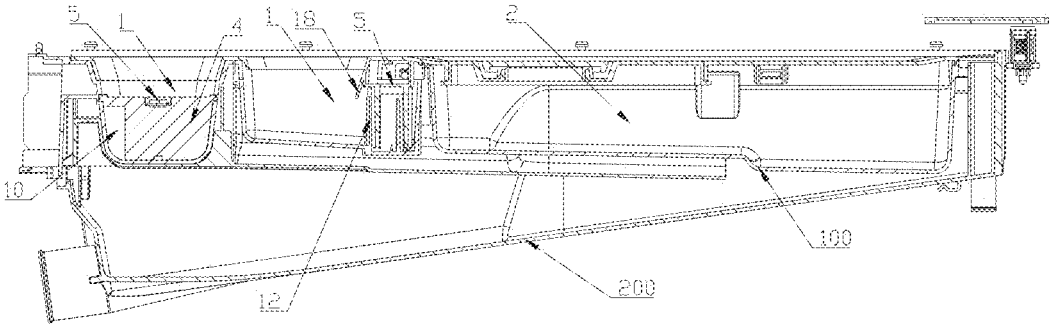
FIG. 12 is an F-F sectional view of FIG. 9 in an embodiment of the present disclosure.
Figure 13:
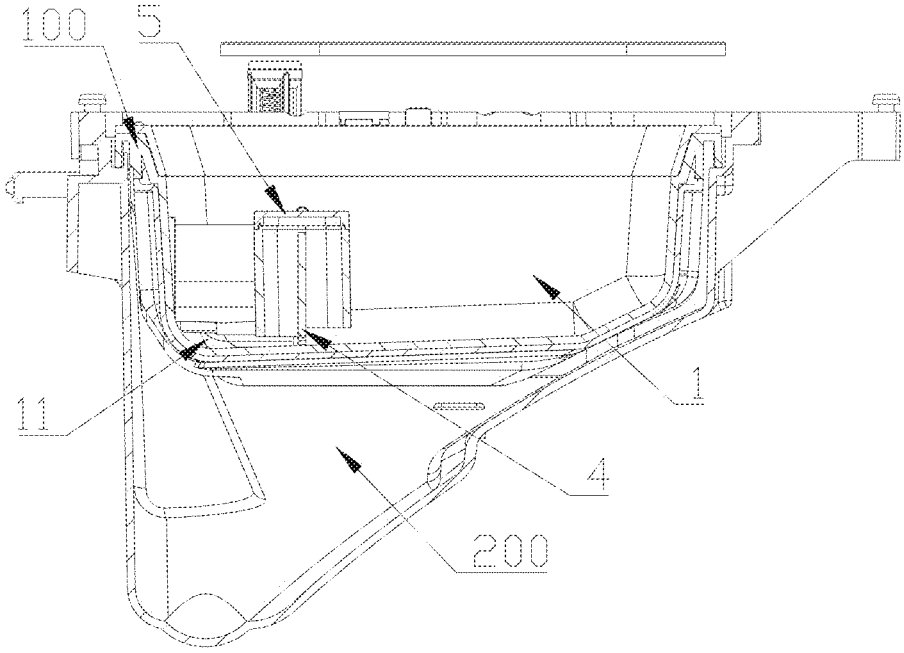
FIG. 13 is a G-G sectional view of FIG. 9 in an embodiment of the present disclosure.
Figure 14:
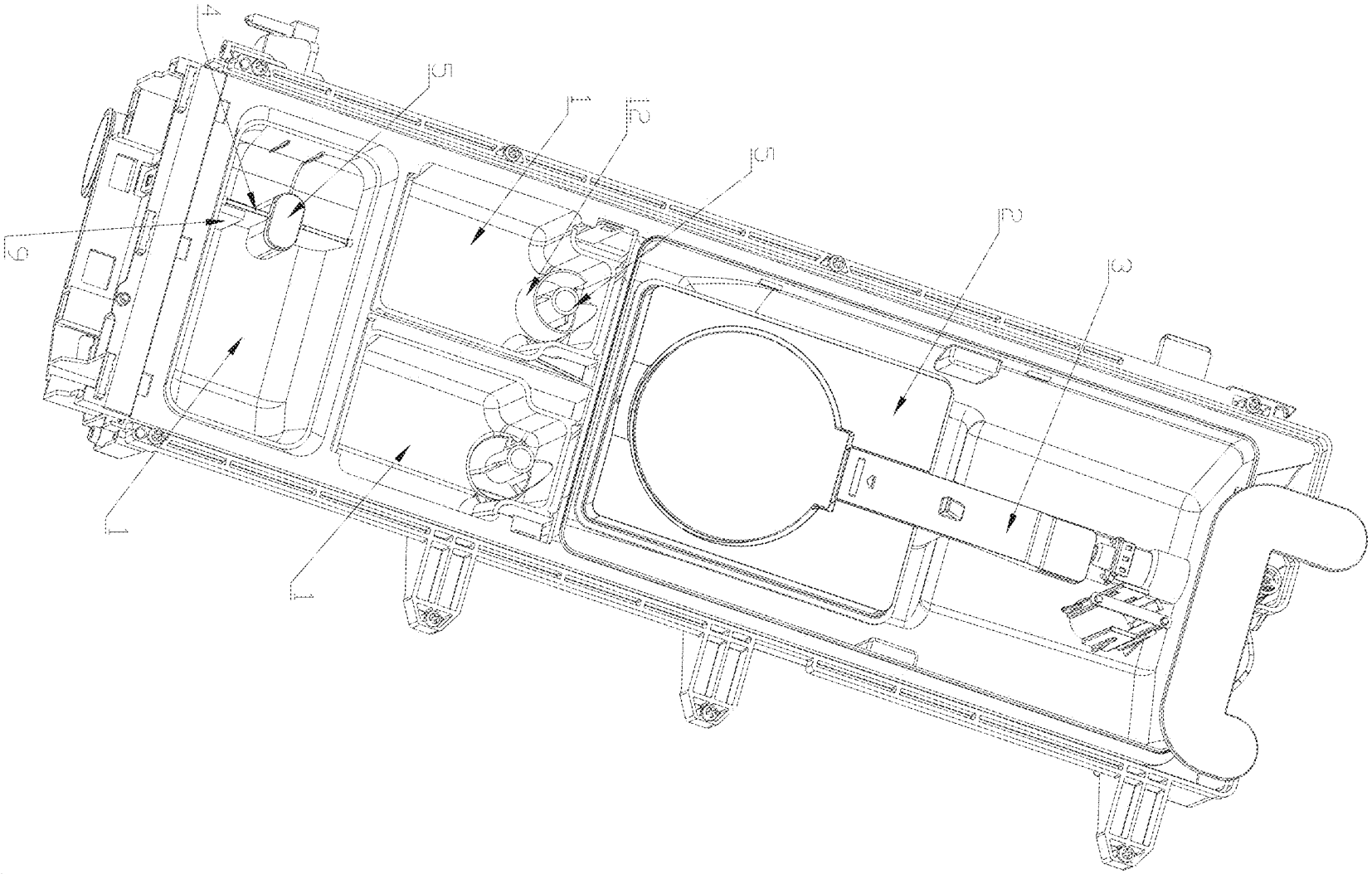
FIG. 14 is a structural schematic diagram of a washing feeding device with a cover plate removed in another embodiment of the present disclosure.

As shown in FIGS. 1-14, an embodiment provides a washing feeding device comprising a water box 200. A feeding box 100 for feeding a detergent and/or washing powder is installed in the water box 200. Preferably, the feeding box 100 is correspondingly inserted into the water box 200 in a pulling manner. At least one feeding chamber 1 is arranged in the feeding box 100. A bottom of the feeding chamber 1 is provided with a water outlet 11 communicating with the water box 200. An inlet water flow of a washing machine flows into the feeding chamber 1, so that the detergent and/or the washing powder added to the feeding box 100 are/is flushed into the water box 200 by the water outlet 11 through an effect of the inlet water. A baffle board 4 for preventing the water from flowing to the water outlet 11 is installed in the feeding chamber 1. A siphon 5 for communicating two sides of baffle board is arranged on the baffle board 4. At an upstream side of the baffle board 4, the detergent fed to the water box 200 from the feeding box 100 and the inlet water are blocked by the baffle board 4 to be accumulated until reaching a liquid level for triggering a siphonic effect, then flow to a downstream side of the baffle board through the siphon 5, and finally flow out from the water box 200 through the water outlet.

By the above arrangement, the detergent added into the feeding chamber by the user can be blocked by the baffle board, thereby preventing the detergent which is not diluted by water from directly flowing into the water box, further realizing the purposes of improving detergent diluting efficiency and enlarging a detergent distribution range.

In the present embodiment, the feeding box 100 can be installed in the water box 200 in a horizontal pulling manner. The baffle board 4 is vertically arranged in middle of the feeding chamber 1. The baffle board 4 and the feeding box 100 are arranged vertically in a pulling direction, and the baffle board 4 covers any vertical cross section of the corresponding feeding chamber 1. The siphon 5 is a flow channel with inverted U-shape. Two ends of the flow channel are respectively located at two sides of the baffle board, and two parts of the feeding chamber 1 separated by the baffle board 4 are communicated with each other via the flow channel. The inlet water flows into the feeding chamber 1 at the upstream side of the baffle board 4, and is blocked by the baffle board 4 to be accumulated to be raised and dilute the detergent fed to the upstream side of the baffle board 4. When the liquid level of the inlet water in the feeding chamber 1 exceeds a corner of the flow channel with inverted U-shape, a siphonic effect is triggered, and further, the inlet water blocked by the baffle board 4 flows to the downstream side of the baffle board 4 through the inverted U-shape baffle board 4.

In the present embodiment, a height of the flow channel at a corner is not lower than a height of a top end of the baffle board 4, to avoid failure of triggering the siphonic effect after the height of washing water accumulated exceeds the baffle board 4, thereby ensuring smooth drain of the detergent via the siphon 5.

In the present embodiment, one end, at the upstream side of the baffle board 4, of the flow channel with inverted U-shape is a water inlet end. The other end, at the downstream side of the baffle board 4, of the flow channel with inverted U-shape is a water outlet end. An interval is formed between the water inlet end and the bottom wall of the feeding chamber for introducing the detergent and water to flow into the flow channel, and an interval is formed between the water outlet end and the bottom wall of the feeding chamber for introducing the detergent and water to flow out of the flow channel.

In the present embodiment, the height of the water inlet end of the flow channel with inverted U-shape is larger than that of the water outlet end, and the detergent and the water at the upstream side of the baffle board flow to the downstream side of the baffle board 4 under the effect of gravity after water in the water channel triggers the siphonic effect.

Preferably, in the embodiment, the bottom wall of the feeding chamber 1 is arranged obliquely downward gradually to the water outlet 11 along a direction vertical to the baffle board 4. The inlet water in the feeding chamber 1 spontaneously converges toward the direction of the water outlet 11 under the effect of gravity. Accumulated water in the upstream side of the baffle board 4 can converge smoothly to the water inlet end of the flow channel with inverted U-shape arranged at the baffle board 4, and water in the downstream side of the baffle board 4 can converge smoothly to the water outlet 11.

In the embodiment, the siphon 5 comprises a main body which is fixedly installed or integrated onto the baffle board 4 and with a tubular shape extending vertically and being hollow inside. A hollow portion of the main body is separated by the baffle board 4 into two mutually independent and vertically extending flow channels: respectively a water inlet flow channel and a water outlet flow channel. A top of the main body is buckled with an upper cover in a sealing manner. A lower side of the upper cover is provided with a groove sinking inward and tops of the water inlet flow channel and the water outlet flow channel are communicated by the groove. The lower ends of the water inlet flow channel and the water outlet flow channel respectively form the water inlet end and the water outlet end.

In the embodiment, a top of the main body is provided with a circle of sealing rib protruding upward. Two circles of coordinating ribs protruding downward are arranged at a periphery of an upper cover. A groove is formed in middle of the coordinating rib at an inner circle. The two circles of coordinating ribs are separated by a certain interval to form an insertion slot, and the sealing rib is correspondingly inserted into the insertion slot to form sealed insertion between the upper cover and the main body. Preferably, a circle of sealing ring is installed in the insertion slot, and is clamped between the insertion slot and the main body. At least one wall of the sealing rib is attached to the insertion slot in a sealing manner, and at least one wall is attached to the main body in a sealing manner, thereby improving sealing performance at the insertion position to avoid water leakage and air leakage.

In the embodiment, the main body and the baffle board 4 are integrally formed; the upper cover is buckled to and fixedly connected to the top of the main body correspondingly.

In the embodiment, two sides, perpendicular to the baffle board 4, of the main body are planes. Two sides, parallel with the baffle board 4, of the main body are arc faces protruding toward an outer side of the main body. In the embodiment, joint places of the arc faces and the planes present smooth transition curved surfaces, to ensure smooth flowing of water in the feeding chamber 1.

In the embodiment, the baffle board 4 is pivoted and installed in the water box 200. The baffle board 4 is vertically arranged while the detergent is fed into the water box 200 by the feeding box 100 so as to block the detergent and the inlet water. The baffle board 4 is horizontally or obliquely arranged while washing powder is fed into the water box 200 by the feeding box 100 so as to facilitate flowing of the washing powder to the water outlet. By arranging the baffle board in a pivoted manner, a corresponding using state is adjusted when the feeding device respectively feeds liquid and solid washing additives, thereby ensuring smooth feeding of the additives.

In the embodiment, two ends of a top of the baffle board 4 are respectively provided with rotary shafts protruding outward. The two rotary shafts are arranged coaxially and penetrate respectively into side walls of the feeding chamber 1 at a corresponding side, so that the baffle board 4 is installed onto the feeding box 100 in an axial rotation manner. In the embodiment, the rotary shafts of the baffle board 4 are connected to a driving motor to drive the baffle board to rotate automatically under the effect of the driving motor, thereby switching the baffle board 4 between a vertical position and a horizontal position. Preferably, reset torsion springs are installed at the rotary shafts of the baffle board 4, and two ends of each reset torsion spring abut against the baffle board and the feeding box 100 respectively, and the tensioned torsion springs provide a reset acting force for the baffle board to drive the baffle board to reset to an initial state.

In the embodiment, when the baffle board 4 is at the vertical position, two sides of the baffle board 4 are correspondingly contacting with an inner side wall of the feeding chamber 1, a lower side of the baffle board 4 is correspondingly contacting with a bottom wall of the feeding chamber 1. Preferably, at least one limit portion protruding to an inside of the water box 200 is arranged on the inner side wall of the feeding chamber 1 for limiting and abutting the baffle board when the baffle board rotates to the vertical position. Preferably, in the embodiment, in order to maintain the baffle board immobile at the vertical position, inner side walls of a left side and a right side of the feeding chamber 1 are provided with first limit ribs extending vertically and protruding to the inside of the feeding chamber 1. The first limit ribs are arranged at vertical positions at lower sides of the rotary shafts of the baffle board correspondingly or at a one side away from the water outlet, and a water inlet side of the baffle board limits and abuts against the first limit rib when the baffle board 4 is in a vertical state.

In the embodiment, in order to avoid causing a too large opening angle when the baffle board 4 rotates to the horizontal position, an inner wall of a rear side of the feeding chamber 1 is provided with a horizontal second limit rib extending in a manner of protruding to the inside of the feeding chamber 1. A height of the second limit rib is equal to heights of the rotary shafts of the baffle board 4, so that a water outlet side of the baffle board 4 limits and abuts against the second limit rib when the baffle board is in a horizontal state.

Embodiment II

As shown in FIGS. 8-14, an embodiment provides a washing feeding device comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet 11 communicating with the water box 200, and an inlet water flow of a washing machine flows into the feeding chamber 1. The detergent and/or the washing powder added to the feeding box 100 flow/flows into the water box 200 by the water outlet through an effect of the inlet water. A baffle board 4 for preventing water from flowing to the water outlet 11 is installed in each feeding chamber 1 in an overturning manner. A gap portion 10 is formed on the baffle board. Another way of inlet water of the water box 200 flows to the gap portion 10 when the baffle board is pivoted. Water washes a bottom wall of the feeding chamber 1 below the baffle board when the baffle board is pivoted after passing through the baffle board 4 through the gap portion 10, and opening the baffle board.

By the above arrangement, the inlet water of the water box flows through the gap portion of the baffle board to wash the bottom wall of the feeding chamber blocked below the baffle board, thereby avoiding residue of the washing powder at the water outlet of the feeding chamber and realizing a purpose of preventing residue of washing powder at the water outlet of the feeding chamber shielded by the baffle board.

In the embodiment, an auxiliary baffle board 9 is arranged on the feeding chamber 1. The gap portion 10 is blocked by the auxiliary baffle board 9 when the baffle board 4 is reset, and the baffle board 4 and the auxiliary baffle board 9 jointly separate the feeding chamber 1 into two mutually independent portions. Thus, when the baffle board 4 with the gap portion is at the vertical position, the baffle board 4 and the auxiliary baffle board 9 jointly form a blocking portion covering a vertical cross section of the feeding chamber 1, and the detergent and the water added to the feeding chamber 1 are blocked by the blocking portion to be accumulated, thus achieving a purpose of diluting the detergent.

In the embodiment, the gap portion 10 on the baffle board 4 is arranged on a position, close to a side wall of the feeding chamber 1, of the baffle board, so that washing water flows from a corresponding side of the feeding chamber 1 and washes the bottom wall of the feeding chamber 1 below the baffle board after passing through the gap portion 10. Preferably, the water outlet of the feeding chamber 1 is formed in a side opposite to the gap portion 10 on the baffle board 4. By arranging the gap portion of the baffle board and the water outlet of the feeding chamber at two opposite sides of the feeding chamber, washing water flows from one side of the feeding chamber to the other opposite side after passing through the gap portion of the baffle board, thereby ensuring complete washing on the bottom wall of the feeding chamber below the baffle board by washing water.

In the embodiment, the water outlet 11 formed in the feeding chamber 1 is located in a groove formed in the bottom wall of the feeding chamber 1. The bottom wall of the feeding chamber 1 is arranged obliquely downward gradually toward the groove from the periphery. Water in the feeding chamber 1 converges to flow to the water outlet 11. Preferably, the water outlet 11 is located in bottom of the groove, and water converging to the groove is drained smoothly from the water outlet 11.

In the embodiment, the auxiliary baffle board 9 is vertically arranged in the feeding chamber 1. At least a portion of a periphery of the auxiliary baffle board 9 protrudes out of a periphery of the gap portion 10 when the baffle board is reset, and the baffle board 4 is limited to a vertical closing position via the auxiliary baffle board 9. Preferably, the auxiliary baffle board 9 is vertically installed inside the feeding chamber 1. One side and a bottom of the auxiliary baffle board 9 are respectively fixedly connected to an inner wall of the feeding chamber 1, and the auxiliary baffle board 9 and the feeding box 100 are integrally molded into one integrated piece.

In the embodiment, the baffle board 4 for preventing water from flowing to the water outlet 11 is installed in the feeding chamber 1. A siphon 5 is arranged on the baffle board for communicating two sides of the baffle board. At an upstream side of the baffle board 4, the detergent fed into the water box 200 from the feeding box 100 and the inlet water are blocked by the baffle board to be accumulated until reaching a liquid level for triggering a siphonic effect, then flow to a downstream side of the baffle board through the siphon 5, and finally flow out from the water box 200 through the water outlet 11.

By the above arrangement, the detergent added into the feeding chamber by the user can be blocked by the baffle board, thereby preventing the detergent which is not diluted by water from directly flowing into the water box, further realizing the purposes of improving detergent diluting efficiency and enlarging a detergent distribution range.

In the embodiment, the baffle board is pivoted and installed in the water box 200. The baffle board 4 is in vertical position, while the detergent is fed into the water box 200 by the feeding box 100 so as to block the detergent and the inlet water. The baffle board 4 is in horizontal or obliquely position, while washing powder is fed into the water box 200 by the feeding box 100 so as to facilitate flowing of the washing powder to the water outlet. By arrangement of the baffle board capable of pivoting, a corresponding using state is adjusted when the feeding device respectively feeds liquid and solid washing additives, thereby ensuring smooth feeding of the additives.

In the embodiment, two ends of a top of the baffle board 4 are respectively provided with rotary shafts protruding outwards. The two rotary shafts are arranged coaxially and penetrate respectively into side walls of the feeding chamber 1 at a corresponding side. The baffle board is installed on the feeding box 100 in an axial rotation manner. In the embodiment, the rotary shafts of the baffle board 4 are connected to a driving motor to drive the baffle board 4 to rotate automatically under an effect of the driving motor, thereby switching the baffle board 4 between a vertical position and a horizontal position. Preferably, the baffle board 4 is provided with reset torsion springs at a position where the rotating shaft is installed, two ends of the reset torsion springs are abutted against the baffle board and the feeding box 100 respectively, and the reset torsion springs provide an acting force for the baffle board to drive the baffle board 4 to rotate to a horizontal state when the reset torsion springs are tensioned.

In the embodiment, when the baffle board 4 is in vertical position, two sides of the baffle board 4 are correspondingly contacting with an inner side wall of the feeding chamber 1. A lower side of the baffle board 4 is correspondingly contacting with a bottom wall of the feeding chamber 1. Preferably, at least one limit portion protruding to an inside of the water box 200 is arranged on the inner side wall of the feeding chamber 1 for limiting and abutting the baffle board when the baffle board 4 rotates to the vertical position. Preferably, inner side walls on a left side and a right side of the feeding chamber 1 are provided with first limit ribs extending vertically and protruding to the inside of the feeding chamber 1. The first limit ribs are arranged at corresponding vertical positions at lower sides of the rotary shafts of the baffle board correspondingly or at one side away from the water outlet, and a water inlet side of the baffle board limits and abuts against the first limit rib when the baffle board is in a vertical state.

In the embodiment, in order to avoid a too large opening angle when the baffle board 4 rotates to the horizontal position, an inner wall of a rear side of the feeding chamber 1 is provided with a horizontal second limit rib extending in a manner of protruding to the inside of the feeding chamber 1, a height of the second limit rib is equal to height of the rotary shafts of the baffle board 4, and the water outlet side of the baffle board 4 limits and abuts against the second limit rib when the baffle board is in a horizontal state.

Embodiment III

As shown in FIGS. 1 to 14, an embodiment provides a washing feeding device, comprising a water box 200, wherein a feeding box 100 is installed in the water box 200 for feeding a detergent and/or washing powder. Preferably, the feeding box 100 is correspondingly inserted into the water box 200 in a pulling manner. A downpipe 13 is arranged inside the feeding box 100. The downpipe 13 is vertically penetrating through an upper side and a lower side of the feeding box 100. An upper end and a lower end of the downpipe 13 are respectively located at an upper side wall and a lower side wall of the feeding box 100, to guide residual water on a top surface of the feeding box 100 to a bottom of the water box 200 below the feeding box 100 through the downpipe 13.

By arranging the downpipe is arranged on the feeding box of the feeding device in a vertical penetration manner. Residual inlet water on the top surface of the feeding box flows to the bottom of the water box below the feeding box through the downpipe, thereby avoiding residue of water on the top surface of the feeding box, and further preventing the residual water from leaking to the outside of a washing machine when the user pulls the feeding box out.

In the embodiment, the feeding box 100 comprises a main body, and a hollow portion inside the main body forms a liquid storage chamber 2. A top of the liquid storage chamber 2 is provided with an opening. A top of the main body is provided with an upper cover 17 buckled to the opening. A drain opening 14 penetrating up and down is arranged on the upper cover 17, and is communicated with the downpipe 13.

In the embodiment, the downpipe 13 extending vertically is arranged inside the liquid storage chamber 2. A bottom opening of the downpipe 13 extends out from a bottom wall of the liquid storage chamber 2. A top of the downpipe 13 is contacting with the upper cover 17 in a sealing manner, and a top opening of the downpipe 13 is arranged coaxially with the drain opening 14. Preferably, a size of the top opening of the downpipe 13 is greater than a size of the drain opening 14, thereby making the top of the downpipe 13 abut against a lower side of the upper cover 17 in a sealing manner.

In the embodiment, the downpipe 13 is located in middle of the liquid storage chamber 2. A liquid outlet for the detergent to flow out is formed closely to a rear side of the liquid storage chamber 2 in a pulling-in direction of the feeding box 100, and a control valve is installed at the liquid outlet.

In the embodiment, the upper cover 17 is provided with a circle of flanging protruding downward at the drain opening 14. The flanging stretches to the inside of the downpipe 13. An outer peripheral wall of the flanging is attached to an inner wall of the downpipe 13 for contact. Preferably, at least one circle of sealing ring is installed at a contact surface of the flanging with the downpipe 13.

In the embodiment, the drain opening 14 is located at the lowest part of the upper cover. In order to improve efficiency of draining residual water on the top surface of the feeding box 100, a groove 15 sinking downward is formed on an upper side of the upper cover. The drain opening 14 is located in a bottom wall of the groove 15, thereby draining all residual water converging to the groove through the drain opening, and further avoiding a retaining area of residual water on the top surface of the feeding box 100 and collecting residual water all into the groove.

In the embodiment, a lower end outlet of the downpipe 13 is formed in middle of the feeding box 100. Preferably, when the feeding box 100 is located in a pull-out state, when a washing additive is added to the liquid storage chamber 2, the outlet of the downpipe 13 is still retained inside the water box 200, to prevent residual water drained along the downpipe from flowing out from the water box 200, thereby avoiding polluting the external ground of the washing machine.

In the embodiment, the top surface of the upper cover 17 is provided with the groove 15 sinking downward. An opening of the groove 15 is covered with a locking rod 3. One end of the locking rod 3 is connected to the upper cover 17 and another end of the locking rod 3 is arranged optionally, to make a movable end of the locking rod 3 generate elastic expansion in a vertical direction under the effect of an external force. An interval exists between a periphery of the locking rod 3 and an inner wall of the groove 15, and the drain opening 14 is formed in a bottom of the groove 15 below the locking rod 3. Further preferably, an optional end of the locking rod 3 or a part close to the optional end is provided with a protruding portion protruding upward. In the embodiment, the locking rod 3 extends along a pulling direction of the feeding box 100. A locking portion 16 protruding upward is provided in a middle of the locking rod 3, and the drain opening 14 is arranged below the locking portion 16 vertically accordingly.

In the embodiment, in order to improve draining efficiency and reduce residual water on the top, a plurality of downpipes 13 can be arranged on the feeding box 100. The downpipes 13 are respectively arranged at different positions of the feeding box 100 to drain residual washing water at different areas on the upper cover 17 of the feeding box 100.

Embodiment IV

As shown in FIGS. 8-14, an embodiment provides a washing feeding device, comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet communicating with the water box 200. An inlet water flow of a washing machine flows into the feeding chamber 1, and the detergent and/or the washing powder added to the feeding box 100 flow/flows into the water box 200 through the water outlet by an effect of the inlet water. At least one feeding chamber 1 arranged on the feeding box 100 is used for feeding a liquid washing additive. A siphon column 5 is installed in the feeding chamber 1, and a center flow channel and a peripheral flow channel are arranged in the siphon column 5. The center flow channel and the peripheral flow channel are mutually independently and vertically extending. Top ends of the center flow channel and the peripheral flow channel are sealed via a siphon cover and communicate with each other. A bottom end of the center flow channel is communicated with the water box 200, and a bottom end of the peripheral flow channel is communicated with the feeding chamber 1. A blocking rib 12 arranged around the periphery of the siphon column is arranged in the feeding chamber 1, and the detergent and the inlet water in the feeding box 100 flow around the blocking rib 12 and into a space between the blocking rib 12 and the siphon column 5 after through the blocking rib 12.

By arranging a circle of blocking rib at the periphery of the siphon column, the siphon column and the feeding chamber are separated, to prevent the siphon column from triggering siphoning by mistake due to increase of the liquid level at the siphon column caused by surging liquid in a process of pulling the feeding box. Thereby it is realized the purpose of preventing "surging" on the siphon column to avoid triggering siphoning by mistake.

In the embodiment, a lower end of the blocking rib 12 is connected to a bottom wall of the feeding chamber 1 in a sealing manner to prevent the detergent in the feeding chamber 1 from directly flowing to an inlet of the siphon column in a bottom of the siphon column 5. Preferably, a top of the blocking rib 12 is higher than a maximum liquid level of the feeding chamber 1. Further preferably, a top of the blocking rib 12 is connected to a top surface of the feeding chamber 1 in a sealing manner.

In the embodiment, the blocking rib 12 at least covers a pulling-out side of the siphon column 5 toward the feeding box 100. An interior of the feeding chamber 1 is separated by the blocking rib 12 into front portion and rear portion, so that the detergent and inlet water at a front side of the siphon column 5 are blocked by the blocking rib 12, to avoid converging to the siphon column 5 and further preventing surging generated by liquid in the feeding chamber 1 from being flowed into the siphon column 5.

In the embodiment, the blocking rib 12 is a circle of arc rib arranged around the periphery of the siphon column 5. A gap for allowing the detergent to pass through is formed in the blocking rib 12. Preferably, the gap in the blocking rib 12, relative to the siphon column 5, is formed in an opposite side of a pull-out direction of the feeding box 100.

In the embodiment, the siphon column 5 is arranged in the feeding chamber 1 close to a rear side. Two ends of the blocking rib 12 with arc-shape respectively extend close to a rear side wall of the feeding chamber 1. Interval gaps are formed between two ends of the blocking rib 12 with arc-shape and the rear side wall of the feeding chamber respectively, and the interval gaps are used for allowing the detergent to pass through.

In the embodiment, the blocking rib 12 is covered by the periphery of the siphon cover, making the siphon cover and the blocking rib 12 overlap on a vertical projection face. A lower side of the siphon cover is apart from a top end of the blocking rib 12 to form a certain interval. The blocking rib 12 blocks the detergent and the inlet water so as to block and isolate surging inside the feeding chamber 1, and meanwhile, the detergent and the inlet water flow to the periphery of the siphon column 5 through the interval between the blocking rib 12 and the siphon cover.

In the embodiment, a pull-out side of the siphon cover toward the feeding box 100 is provided with a shielding rib 18 extending in a downward protruding manner. The shielding rib 18 and the blocking rib 12 are arranged in interval. The shielding rib 18, relative to the blocking rib, is arranged closely to a side, facing a side of the feeding box being pulled out, of the feeding box 100. A lower end of the shielding rib 18 is lower than a top end of the blocking rib 12. The detergent and water can flow through the interval between the shielding rib 18 and the blocking rib 12 to flow between the blocking rib 12 and the siphon column 5.

In the embodiment, a first sleeve extending vertically downward is arranged in middle of the siphon cover, and a second sleeve extending vertically upward is arranged on the bottom wall of the feeding chamber 1. The second sleeve is arranged inside the first sleeve. An interval gap is formed between the first sleeve and the bottom wall of the feeding chamber 1. The interval gap is formed between a top of the second sleeve and the siphon cover. The peripheral flow channel is formed by a space between the first sleeve and the second sleeve. The center flow channel is formed by an inside of the second sleeve. A bottom of the second sleeve is communicated with the water box 200.

In the embodiment, the bottom of the feeding chamber 1 is provided with a groove sinking downward. The siphon column 5 is arranged in the groove, and the blocking rib 12 is arranged at a peripheral edge of the groove. Preferably, the blocking rib 12 is located at the periphery of the groove. Further preferably, one side, toward the siphon column 5, of the blocking rib 12 is coplanar with an inner wall of the periphery of the groove.

In the embodiment, a plurality of feeding chambers 1 is arranged on the feeding box 00. The feeding chambers 1 are respectively used for feeding different types of washing additives. The siphon column 5 and the blocking rib 12 arranged around the periphery of the siphon column 5 are arranged inside at least one of the feeding chambers 1. The detergent in the feeding box 100 flows between the blocking rib 12 and the siphon column 5 after passing through the blocking rib 12.

Embodiment V

As shown in FIGS. 1 to 7, an embodiment provides a washing feeding device, comprising a water box 200. A feeding box 100 is installed in the water box 200 for feeding a detergent and/or washing powder. Preferably, the feeding box 100 is correspondingly inserted into the water box 200 in a pulling manner. At least one feeding chamber 1 is arranged in the feeding box 100. A bottom of the feeding chamber 1 is provided with a water outlet communicating with the water box 200. An inlet water flow of a washing machine flows into the feeding chamber 1, and the detergent or the washing powder added to the feeding box 100 flows into the water box 200 by the water outlet through an effect of the inlet water. At least one feeding chamber 1 arranged on the feeding box 100 is used for feeding a liquid washing additive. A part of opening of the feeding chamber 1 is covered with a cover plate 6, a siphon 5 located below the cover plate 6 is installed in the feeding chamber 1. A hollow portion 7 located at the periphery of the siphon 5 is arranged on the cover plate 6, and water on the cover plate 6 flows through the hollow portion 7 to the feeding chamber 1 below.

By arranging the hollow portion at the periphery of the siphon on the cover plate of the feeding chamber, inlet water for washing on a top surface of the feeding box flows into the feeding chamber through the hollow portion, thereby avoiding residue of the inlet water on the top surface of the feeding box. Meanwhile, water on the top surface of the feeding box flows into the feeding chamber through the hollow portion close to the siphon, so that the water can flow downward along an outer wall of the siphon to wash the outer wall surface of the siphon, thereby avoiding residue of the detergent on the outer wall of the siphon and preventing generation of water stain.

In the embodiment, a groove 8 sinking downward is formed in the cover plate 6. The groove 8 is correspondingly formed above the siphon 5. A bottom of the groove 8 is provided with the hollow portion 7 interlaced with the siphon 5. By forming the groove sinking downward on the cover plate, the inlet water on the top surface of the cover plate can be rapidly collected into the groove, thereby avoiding expansion of a retaining scope of residual water on the top surface of the feeding box.

In the embodiment, left side and right side of the siphon 5 are symmetrically arranged relative to a pulling direction of the feeding box 100, and respectively provided with the hollow portion 7. Water on the top surface of the feeding box 100 flows respectively through hollow portions 7 arranged at left side and right side of the siphon 5 to wash peripheries of the siphon 5 below the cover plate 6.

In the embodiment, the hollow portions 7 at the left side and right side of the siphon 5 are arc-shape. Inner peripheries of the hollow portions 7 with arc-shape are vertically parallel and level with an outer periphery of the siphon 5. And water flowing into the feeding chamber 1 from the inner peripheries of the hollow portions 7 flows along the outer wall of the siphon 5 into the feeding chamber 1 to directly wash the outer wall of the siphon 5.

In the embodiment, front side and rear side of the siphon 5 are respectively connected to the cover plate 6 through connecting ribs extending vertically. A top of the siphon 5 is formed a bottom of the groove 8, and the connecting ribs arranged front side and rear side of the siphon 5 is formed side walls of the groove 8. Walls of the groove 8 except the connecting ribs and the top of the siphon 5 are provided the hollow portions 7. The top of the siphon is the bottom of the groove, and water flowing into the groove from the top surface of the feeding box washes a top surface of the siphon, thereby effectively avoiding generation of water stain on the top surface of the siphon.

In the embodiment, an opening of the cover plate 6 forming a top opening of the groove 8 is provided with an arc-shape chamfered flanging bending downward, and an outer surface of the feeding box 100 is arranged circularly and smoothly to avoid the situation of scratching a user.

In the embodiment, the inlet water flow of the water box 200 flows to a place above the cover plate 6 and/or the hollow portions 7 and into the feeding chamber 1 through the hollow portions 7 to wash side walls of the siphon 5 and/or a bottom wall of the water box 200. By disposing the inlet water flow for washing the top surface of the feeding chamber on the water box of the feeding device, the inlet water flows into the feeding chamber through the hollow portions arranged on the top surface of the feeding chamber. After washing the top surface of the feeding chamber with washing water, the washing water is used again for washing the outer surface of the siphon below the hollow portion, thereby effectively avoiding generation of water stain on outer walls of the siphon.

The above are merely preferred embodiments of the present invention, rather than restricting the present invention in any form. Although the preferred embodiments of the present disclosure are disclosed above, they are not used to restrict the present invention. Based on the technical content described above, changes or modifications made by any person skilled in the art without departing from the scope of the technical solution of the present invention are equivalently changed equivalent embodiments. For any content without departing from the technical solution of the present invention, any simple change, equivalent change and modification made to the above embodiments according to the technical substance of the present invention belong to the scope of the solution of the present invention.

The invention claimed is:

1. A detergent feeding device, comprising:

a water box;

a feeding box, installed in the water box, at least one feeding chamber, arranged in the feeding box; and a stop plate, for preventing water from flowing toward a water outlet, arranged in the feeding chamber;

a siphon, arranged on the stop plate for communicating one side of the stop plate with the other side of the stop plate, so that at an upstream side of the stop plate, a detergent fed to the water box from the feeding box and water flow, flows to a downstream side of the stop plate along the siphon, and flows out from the water box via the water outlet after being blocked by the stop plate and accumulated up to a water level for triggering a siphonic effect, wherein the siphon includes a main body with a tubular shape extending vertically and being hollow inside, a hollow portion of the main body with the tubular shape is separated by the stop plate into a water inlet flow channel and a water outlet flow channel, a top of the main body with the tubular shape is attached with an upper cover in a sealing manner, the top of the main body with the tubular shape includes a circular sealing rib protruding upward, two circular coordinating ribs protruding downward are arranged in a periphery of the upper cover, a groove is formed in a middle of the coordinating ribs at an inner portion and communicates with a top of the water inlet flow channel and the water outlet flow channel; and the two circular coordinating ribs are separated by an interval to form an insertion slot, and the sealing rib is inserted into the insertion slot to form sealed insertion between the upper cover and the tubular main body.

2. The detergent feeding device according to claim 1, wherein, the water inlet flow channel is located at an upstream side of the stop plate, and the water outlet flow channel is located at a downstream side of the stop plate, and a water inlet end of the water inlet flow channel and a water outlet end of the water outlet flow channel are apart from a bottom wall of the feeding chamber by an interval for allowing the detergent and the water flow to flow into or out of the inverted U-shaped flow channel.

3. The detergent feeding device according to claim 2, wherein, the water inlet end of the water inlet flow channel is higher than the water outlet end of the water outlet flow channel.

4. The detergent feeding device according to claim 1, wherein, the main body is fixedly installed or integrated onto the stop plate.

5. The detergent feeding device according to claim 1, wherein, the main body with the tubular shape and the stop plate are integrally formed.

6. The detergent feeding device according to claim 1, wherein, the stop plate is installed in the feeding chamber in an overturning manner, the stop plate is configured to be in a vertical position while the detergent is fed into the water box from the feeding chamber, and the stop plate is configured to be in a horizontal or oblique position while washing detergent is fed into the water box by the feeding chamber, so as to flush the washing detergent to the water outlet.

7. The detergent feeding device according to claim 6, wherein, when the stop plate is at the vertical position, two sides of the stop plate are correspondingly in contact with inner walls of the feeding chamber, a lower side of the stop plate is correspondingly in contact with the bottom wall of the feeding chamber.

8. The detergent feeding device according to claim 2, wherein, the bottom wall of the feeding chamber is arranged obliquely downward toward the water outlet in a direction vertical to the stop plate.

9. The detergent feeding device according to claim 6, wherein, two ends of the top of the stop plate are respectively provided with rotary shafts protruding outward, the two rotary shafts are arranged coaxially and penetrate respectively into side walls of the feeding chamber, such that the stop plate is installed onto the feeding box in an axial rotation manner.

10. The detergent feeding device according to claim 6, wherein, at least one limit portion protruding to the inside of the feeding chamber is arranged on the inner walls of the feeding chamber for making the limit portion abut against the stop plate when the stop plate is in the vertical position.

* * * * *